US008960437B2

(12) United States Patent
Takenaka

(10) Patent No.: US 8,960,437 B2
(45) Date of Patent: Feb. 24, 2015

(54) GAS STORING PACKING MATERIAL AND PACKING METHOD

(71) Applicant: Toshiko Takenaka, Sendai (JP)

(72) Inventor: Toshiko Takenaka, Sendai (JP)

( * ) Notice: Subject to any disclaimer, the term of this patent is extended or adjusted under 35 U.S.C. 154(b) by 0 days.

(21) Appl. No.: 13/801,507

(22) Filed: Mar. 13, 2013

(65) Prior Publication Data

US 2013/0270145 A1 Oct. 17, 2013

(30) Foreign Application Priority Data

Mar. 15, 2012 (JP) ..... 2012-58347

(51) Int. Cl.

| | |
|---|---|
| ***B65D 81/03*** | (2006.01) |
| ***B65D 30/24*** | (2006.01) |
| ***B65D 81/02*** | (2006.01) |
| ***B65D 81/05*** | (2006.01) |

(52) U.S. Cl.

CPC ..... *B65D 81/022* (2013.01); *B65D 81/03* (2013.01); *B65D 81/052* (2013.01)

USPC ..... 206/522; 383/3

(58) Field of Classification Search

CPC ..... B65D 81/03; B65D 81/052; B65D 85/30; A45C 7/0081; A45C 13/021

USPC ..... 206/522; 383/3

See application file for complete search history.

(56) References Cited

U.S. PATENT DOCUMENTS

| | | | | |
|---|---|---|---|---|
| 6,149,002 | A * | 11/2000 | Tiramani et al. | 206/320 |
| 6,415,920 | B1 * | 7/2002 | Tiramani et al. | 206/320 |
| 6,513,974 | B2 * | 2/2003 | Malone et al. | 383/3 |
| 6,913,803 | B2 * | 7/2005 | Peper | 206/522 |
| 7,223,461 | B2 * | 5/2007 | Kannankeril et al. | 206/522 |
| 7,807,253 | B2 * | 10/2010 | Kannankeril | 206/522 |
| 2005/0284791 | A1 * | 12/2005 | Sadow | 206/522 |
| 2007/0221530 | A1 * | 9/2007 | Lee | 206/522 |

FOREIGN PATENT DOCUMENTS

| | | |
|---|---|---|
| JP | 2002-225945 | 8/2002 |
| JP | 2006-298383 | 11/2006 |
| JP | 2009-161245 | 7/2009 |

* cited by examiner

*Primary Examiner* — Bryon Gehman

(74) *Attorney, Agent, or Firm* — Morrison & Foerster LLP

(57) ABSTRACT

In a packing material 1 including a plate-shaped member having a surface of thermal weldability, and a gas storing section formed by thermally welding plastic film members having thermal weldability and flexibility and configured to store a gas, the packing material has a planar section formed by linearly thermally welding the plate-shaped member and the plastic film member to form the gas storing section configured to store a gas, and a connecting section bent by thermally welding the plate-shaped member and the plastic film member, and is bent at the connecting section to form a three-dimensional shape to store a material to be packed.

7 Claims, 13 Drawing Sheets

GAS STORING PACKING MATERIAL AND PACKING METHOD

CROSS REFERENCE TO RELATED APPLICATION

This Nonprovisional application claims priority under 35 U.S.C. §119 on Patent Application No. 2012-58347 filed in Japan on Mar. 15, 2012, the entire contents of which are hereby incorporated by reference.

BACKGROUND

1. Technical Field

The present invention relates to a packing material used as a cushioning material configured to store a fluid such as a gas or liquid and protect a material to be packed, and a packing method using the packing material.

2. Related Art

In general, while an electrical product such as a notebook computer or the like is packed using styrene foam as a packing material, the styrene foam causes a large burden in storage and distribution costs before packing. In order to solve the problem, a need to use a plastic film as an air packing material for packaging is increasing.

Various kinds of materials are provided from the related art to use a gas seal bag formed of a plastic film as an air packing material for packaging.

In particular, a gas seal bag disclosed in Japanese Patent Application Laid-Open No. 2002-225945 is constituted by a supply path 2 of air formed by overlapping plastic films and adhering necessary places thereof and a sealing bag 3 of air connected to one side edge thereof, and a plurality of partition sealing bags 4 of air to which the sealing bag 3 is adhered at a plurality of places and a check valve 5 disposed to communicate and block each of the partition sealing bags 4 and the supply path 2 are installed at the sealing bag 3. The gas seal bag is configured to naturally form an accommodating space of an object to be packed having a required depth by folds 6 formed by separately adhering two rows in both sides of the sealing bag 3 in a direction transverse to each of the partition sealing bags 4.

However, in the gas seal bag, since the seal bag main body needs to have a size to cover the entire packing object, a large amount of plastic film is needed when a capacity of a packing object is large.

In addition, a packaging apparatus disclosed in Japanese Patent Application Laid-Open No. 2006-298383 includes a bottom skid having an upper surface to which a body to be packaged is fixed, a prismatic body configured to cover from an upper portion of a body to be packaged fixed to the bottom skid, an upper box body in which a packing material configured to protect an upper portion of a body to be packaged in a box body with a bottom surface open and configured to cover the upper portion of the body to be packaged, and a cover member detachably installed on an outer surface ground area of the upper box body abutting the planar member when a side surface of a packing box constituted by the prismatic body and the upper box body is grounded, and is integrated by fastening an outer circumference including a portion of the cover member with a band.

Then, it is described that "as shown in FIG. 2, a cover member 6 has a substantially octagonal planar shape upon deployment, and bend lines 6b and perforated lines 6c are respectively formed therein," and a planar member such as corrugated cardboard is used as a cover member.

However, since a portion of the body to be packaged is protected and then fastened by a band to be integrated, the protection is insufficient.

In addition, a bendable multistage cushioning multiwall sack disclosed in Japanese Patent Application Laid-Open No. 2009-161245 is a bendable multistage cushioning multiwall sack used for packing of an article, and includes a first seal bag sheet including a plurality of first cushioning zones, a second seal bag sheet including a plurality of second cushioning zones, and a light reflective piece attached to a side surface of the first seal bag sheet near the second seal bag sheet and configured to reflect light by the article. One end of the second seal bag sheet is connected to the first seal bag sheet to come in contact with the first seal bag sheet, the plurality of second cushioning zones correspond to the plurality of first cushioning zones, respectively, three sides of the first cushioning zone corresponding to each of the second cushioning zones are adhered by heat seal to form an accommodating space configured to accommodate the article, and the article is cushioned and protected by the first seal bag sheet and the second seal bag sheet.

However, in these sheets, side surfaces of the body to be packaged cannot be sufficiently protected.

SUMMARY

Here, in consideration of the problems, it is an aspect of the present invention to provide a packing material using a cushioning material capable of protecting all sizes of rectangular parallelepiped shapes by forming a shape enabling easy transportation and manufacture, supplying a gas or liquid, storing a gas storing section, and protecting surfaces, corners, or the like, of a material to be packed.

According to an aspect of the present invention, a packing material of the present invention includes a plate-shaped member having a surface of thermal weldability; and a gas storing section formed by thermally welding plastic film members having thermal weldability and flexibility and configured to store a gas, wherein the packing material has: a planar section forming a gas storing section configured to store a gas by linearly thermally welding the plate-shaped member and the plastic film member; and a connecting section bent by thermally welding the plate-shaped member and the plastic film, and is bent at the connecting section to form a three-dimensional shape to store a material to be packed.

In addition, in the packing material of the present invention, at least one of the plastic film members may cover the entire plate-shaped member.

Further, in the packing material of the present invention, the six plate-shaped members may be used to assemble a rectangular parallelepiped (including a cube) body.

Furthermore, in the packing material of the present invention, the packing material may include the plurality of plastic film members overlapping to form a gas storing section in which the planar section is a multi-stage.

In addition, the packing material of the present invention may have a plurality of stages of gas storing sections at the planar section.

Further, in the packing material of the present invention, the planar section formed by the plastic film member and the plate-shaped member has: an injection section configured to inject a gas from the outside; a circulation path to the gas storing section configured to store the gas from the injection section; and a gas inlet port configured to fill the gas from the circulation path to the gas storing section.

Furthermore, in the packing material of the present invention, the gas inlet port may have a check valve configured to prevent leakage of the filled gas.

In addition, in the packing material of the present invention, the gas inlet port may form a valve unit with one or two sheet members inserted between two sheets of the plate-shaped member and the plastic film members.

Further, in the packing material of the present invention, all of the gas storing sections may be connected without thermally welding portions of the planar section and the connecting section, and a gas may be injected into one gas inlet port.

Furthermore, in the packing material of the present invention, a plurality of gas storing sections may be connected without thermally welding portions of the planar section and/or the connecting section.

In addition, in the packing material of the present invention, the plurality of packing materials according to any one of the foregoing are connected.

Further, in the packing material of the present invention, the plate-shaped member may be formed of a plastic material selected from thermoplastic resins such as polyethylene, polypropylene, polystyrene, and polyethyleneterephthalate, and the plastic film member may be formed of one of polyamide, fluororesin, silicone resin, and a metal film laminated with a thermoplastic resin such as polyethylene or polypropylene.

Furthermore, in the packing material of the present invention, the plate-shaped member may be formed of corrugated cardboard coated with a plastic selected from thermoplastic resins such as polyethylene, polypropylene, polystyrene, and polyethyleneterephthalate, and the plastic film member may be formed of one of polyamide, fluororesin, silicone resin, and a metal film laminated with a thermoplastic resin such as polyethylene or polypropylene.

A packing method of the present invention of storing a material to be packed using a packing material includes storing a gas in the packing material according to any one of the foregoing to fill a gas storing section, and storing the material to be packed to assemble the packing material.

As can be seen from the foregoing, according to the packing material of the present invention, it is possible to provide the packing material capable of stably protecting the material to be packed having various sizes of rectangular parallelepipeds and other shapes. In addition, since the air can be injected at the location at which it is used, storage and transportation of the packing material itself can be easily performed.

According to the packing method of the present invention, it is possible to provide the packing method capable of stably protecting the material to be packed having various sizes of rectangular parallelepipeds and the other shapes.

DETAILED DESCRIPTION

Figure 1A:
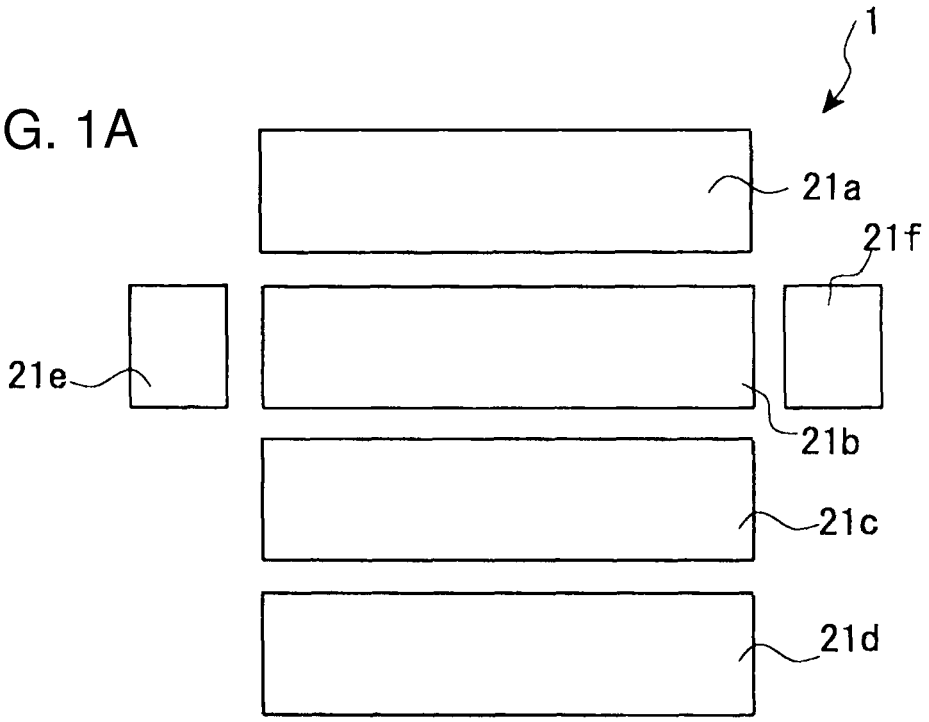
FIGS. 1A and 1B are schematic views showing disposition of a plate-shaped member of a packing material according to an embodiment of the present invention.

Various exemplary embodiments, features, and aspects of the invention will be described in detail below with reference to the drawings.

Hereinafter, a best mode for performing the present invention will be described with reference to the accompanying drawings. The following description is an example of embodiments of the present invention, but does not limit the scope of the accompanying claims.

In addition, it will be apparent to those skilled in the art that modifications and corrections of the present invention can be easily made to form another embodiment, and these modifications and corrections also fall into the scope of the accompanying claims.

A packing material 1 of the present invention includes a plate-shaped member 21 having a surface of thermal weldability, and a gas storing section 42 formed by thermally welding a plastic film member 22 having thermal weldability and flexibility and configured to accommodate a gas. For this reason, the packing material 1 of the present invention has a planar section 40 forming the gas storing section 42 configured to accommodate a gas by linearly thermally welding the plate-shaped member 21 and the plastic film member 22, a connecting section 50 bent by thermally welding the plate-shaped member 21 and the plastic film member 22.

FIG. 1 is a schematic view showing disposition of the plate-shaped member of the packing material according to the embodiment of the present invention.

The packing material 1 of the present invention has at least one plate-shaped member (hereinafter, simply referred to as "a plate-shaped member") 21. Further, the plate-shaped member 21 has thermal weldability at a surface thereof. Accordingly, the plate-shaped member 21 can be easily melted and adhered to another member by application of heat. Any materials that have thermal weldability and thus thermoplasticity may be used. While modified olefins having appropriate adhesion such as polypropylene, polyethylene, polyethyleneterephthalate (PET), polyamide, or the like, ethylene vinyl acetate (EVA) copolymer resins, polyesters, chloroprene rubbers, styrene-butadiene rubbers, urethane rubbers, or the like, may be used, the modified olefins are preferable in terms of strength and adhesion affinity with a flexible base sheet. In particular, a plastic material selected from thermoplastic resins of polyethylene, polypropylene, polystyrene, and polyethyleneterephthalate may be used.

Further, since the surface may favorably have thermal weldability, the packing material 1 of the present invention may be paper such as corrugated cardboard, thick paper, or the like, or a wood product such as a palette, a plate, or the like, on which a thermoplastic resin is coated on a surface thereof.

In addition, the packing material 1 of the present invention has a box shape or rectangular parallelepiped (including a cube) shape formed by bending or assembling the plate-shaped member 21 having a constant stiffness and formed of a material that cannot be easily deformed. Accordingly, when the packing material 1 is provided, a material to be packed 90 packed therein can be protected.

As shown in FIG. 1A, while the plate-shaped member 21 is described with reference to six plate-shaped members 21*a* to 21*f*, it is not limited to the six members. The material to be packed 90 may be appropriately applied according to a material or a state thereof even when it protected by two sheets at upper and lower sides or three sheets at the upper and lower sides and one side surface thereof. Further, similarly, the plate-shaped member 21 formed of one plastic sheet may be bent or assembled and used.

Figure 1B:
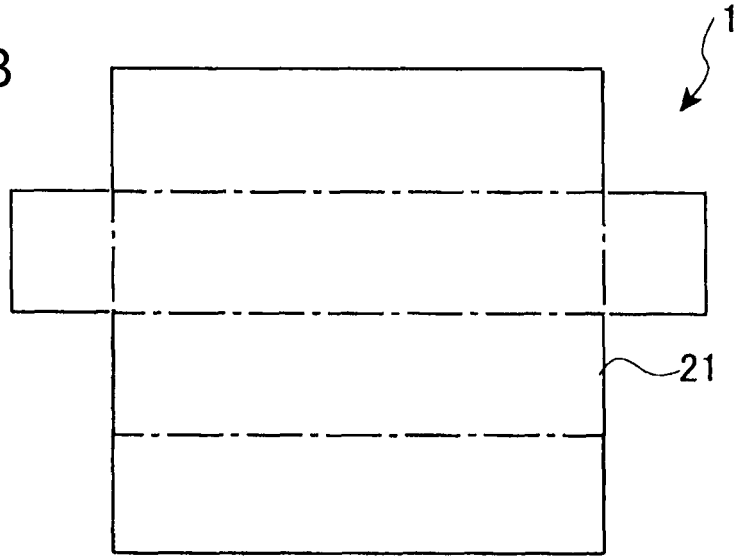

As shown in FIG. 1B, the plate-shaped member 21 formed of one plastic sheet may be used as long as it can be bent at a chain line shown in the drawing. In addition, similarly, the plate-shaped member 21 formed of corrugated cardboard, continuously formed without partial cutting and separation, and enabling easy bending may be used.

Figure 2A:
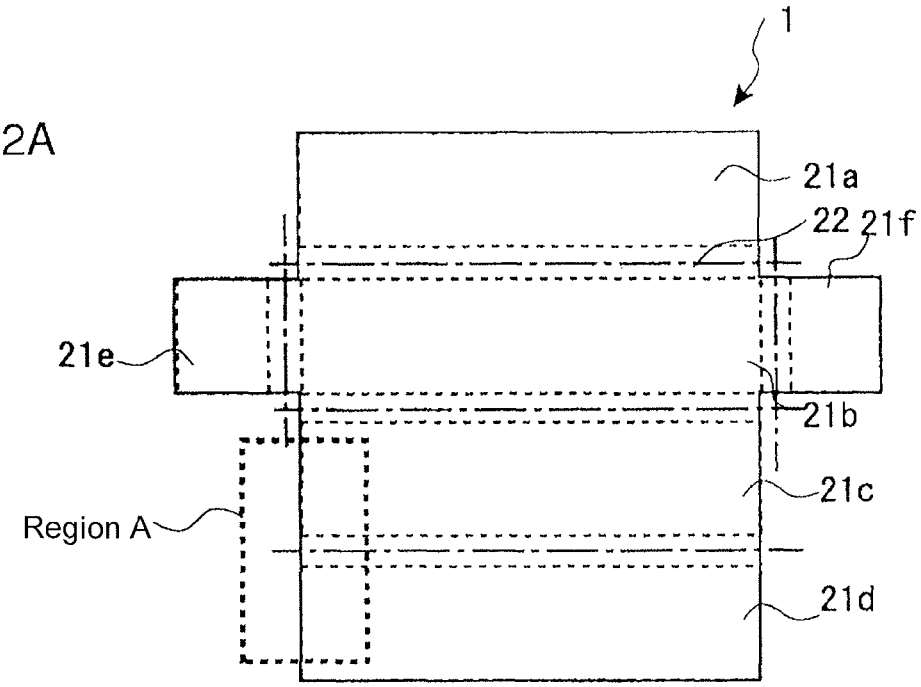
FIGS. 2A and 2B are schematic views showing disposition of a plastic film member of the packing material according to the embodiment of the present invention, FIG. 2A showing a shape conforming to a shape in which a plate-shaped member is disposed, and FIG. 2B showing a rectangular shape configured to cover the entire shape in which the plate-shaped member is disposed.
Figure 2B:
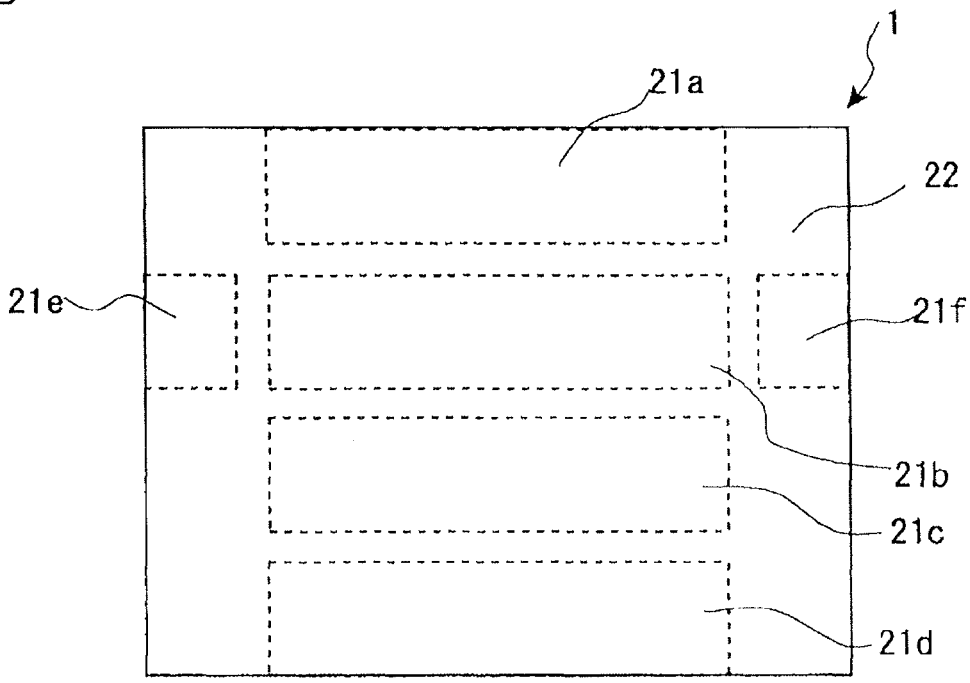

FIGS. 2A and 2B are a schematic view showing disposition of the plastic film member of the packing material according to the embodiment of the present invention, FIG. 2A showing a shape conforming to a shape in which the plate-shaped member is disposed, and FIG. 2B showing a rectangular shape configured to cover the entire shape in which the plate-shaped member is disposed.

The packing material 1 of the present invention includes the plastic film member (hereinafter, simply referred to as "a film member") having thermal weldability. As shown in FIGS. 2A and 2B, while the plate-shaped member 21 and the film member 22 have at least a portion of the plate-shaped member 21 not welded to supply air, the members are welded at the entire overlapping circumferential edge sections to form the gas storing section 42 configured to store a gas. In addition, the gas storing section 42 will be described below.

Further, the film member 22 has flexibility, and thus, can be easily bent without destruction or damage.

While modified olefins having appropriate adhesion such as polypropylene, polyethylene, polyethyleneterephthalate (PET), polyamide, or the like, ethylene vinyl acetate (EVA) copolymer resins, polyesters, chloroprene rubbers, styrene-butadiene rubbers, urethane rubbers, or the like, can be used as the plastic film member 22 constituting the packing material 1 of the present invention, the modified olefins are preferable in terms of strength and adhesion affinity with a flexible base sheet. In particular, a plastic product selected from thermoplastic resins such as polyethylene, polypropylene, polystyrene, and polyethyleneterephthalate may be used.

In particular, plastic films having thermal weldability of polyethylene, polypropylene, or the like, may be laminated on both surfaces of a film of polyamide, fluororesin, silicone resin, or the like, to sandwich the film. In addition, the film sandwiched therebetween may be a metal film such as an aluminum film or the like. An intermediate film may be prepared in consideration of gas permeability. A material having thermal weldability is provided on at least one surface of the plastic film member 22 because inner surfaces of the plate-shaped members 21 need to be thermally welded to integrate the members.

Figure 3A:
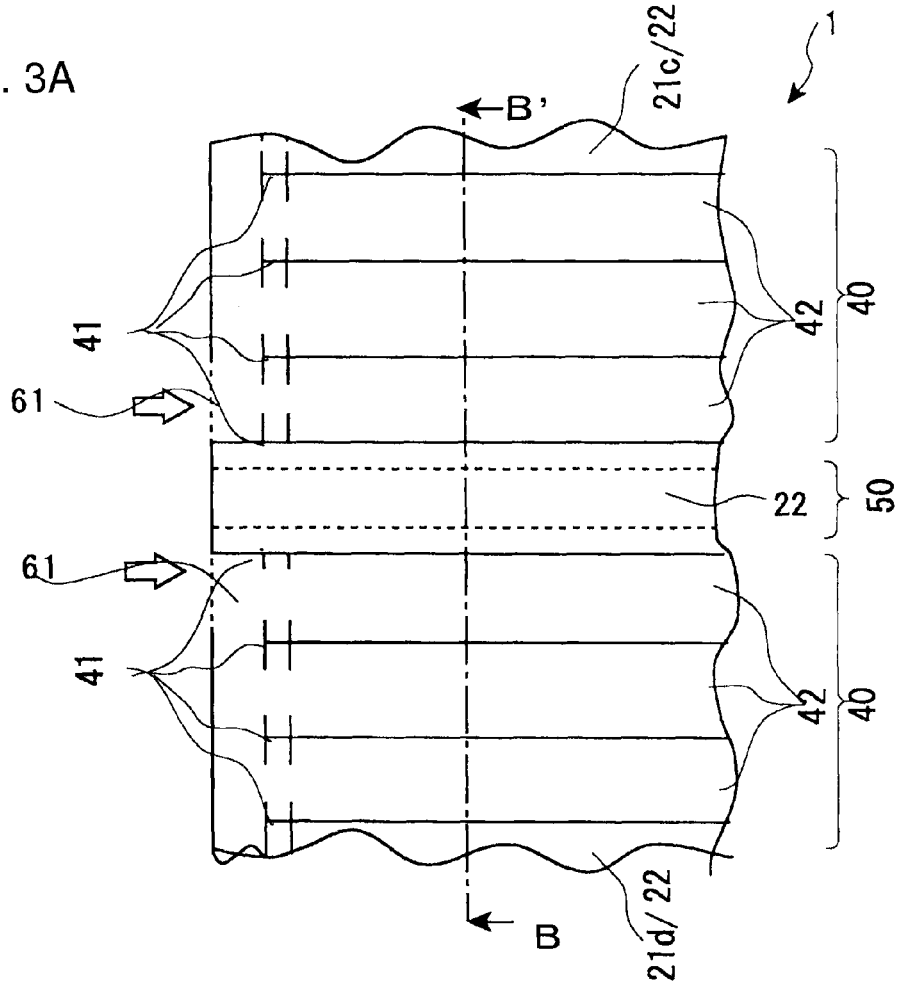
FIGS. 3A and 3B are schematic views showing a configuration of the packing material according to the embodiment of the present invention, FIG. 3A showing a partial plan view, and FIG. 3B showing a cross-sectional view taken along line B-B'.
Figure 3B:
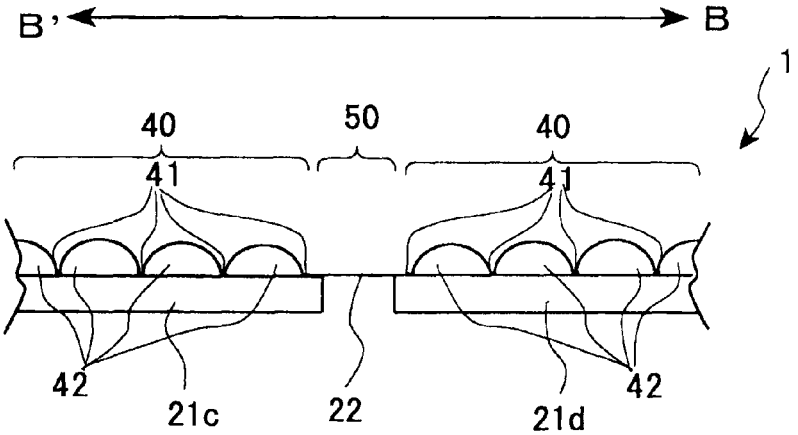

FIG. 3 is a schematic view showing a configuration of the packing material according to the embodiment of the present invention, FIG. 3A showing a partial plan view, and FIG. 3B showing a cross-sectional view taken along line B-B'. FIG. 3 is an enlarged view showing a region A of FIG. 2A.

Further, the packing material 1 of the present invention is constituted by the planar section 40 and the connecting section 50.

The planar section 40 has linear thermal welding sections 41, and the gas storing section 42 formed between the thermal welding sections 41. The planar section 40 has the linear thermal welding sections 41, and the gas storing section 42 formed between the thermal welding sections 41.

In addition, while the gas storing section 42 in the planar section 40 may be formed by thermally welding the circumferential edge section of the plate-shaped member 21, as shown in FIG. 3, the plurality of linear thermal welding sections 41 are formed, and the plurality of gas storing sections 42 are formed. Accordingly, as shown in FIGS. 3A and 3B, the plurality of gas storing sections 42 can come in contact with surfaces of the material to be packed 90 at heights of the plurality of gas storing sections 42. Accordingly, the material to be packed 90 can always be protected. In addition, even when a large impact is applied to the material to be packed 90, destruction and damage of the material to be packed 90 can be prevented by receiving the impact in a distributed manner.

Further, as shown in FIG. 3A, in the planar section 40, an injection section 61 corresponding to an inlet into which a gas is injected and fed thereinto, and a circulation path 62 through which the injected gas passes allow the gas to be divided and flowed from the circulation path 62, and then are connected to a gas inlet port 64. As the gas injected from the gas inlet port 64 is stored, the gas storing section 42 is expanded. In addition, an introduction path 63 from the circulation path 62 to the gas inlet port 64 may be formed. Here, after the gas is injected from the injection section 61, leakage of the gas to the outside is prevented by closing the injection section 61. The closing is performed by applying and thermally welding the injection section 61. In addition, a bonding agent or an adhesive tape may be used.

Further, as shown in FIGS. 3A and 3B, the connecting section 50 has only the film member 22, and the plate-shaped member 21 is not provided. Since the film member 22 has flexibility and a constant strength, the thermally welded plate-shaped member 21 can be held. Accordingly, as shown in FIGS. 2A and 2B, according to the above-mentioned structure, the six plate-shaped members 21*a* to 21*f* are adhered and integrated. In this case, the plate-shaped member 21 is not limited to the six members, two or three members may be provided in consideration of a shape, a weight, and a surface to be protected of the material to be packed 90, and the packing material 1 of the present invention can correspond thereto.

In addition, if the plate-shaped member 21 such as bendable corrugated cardboard or the like is prepared, one sheet may be possible.

Figure 4:
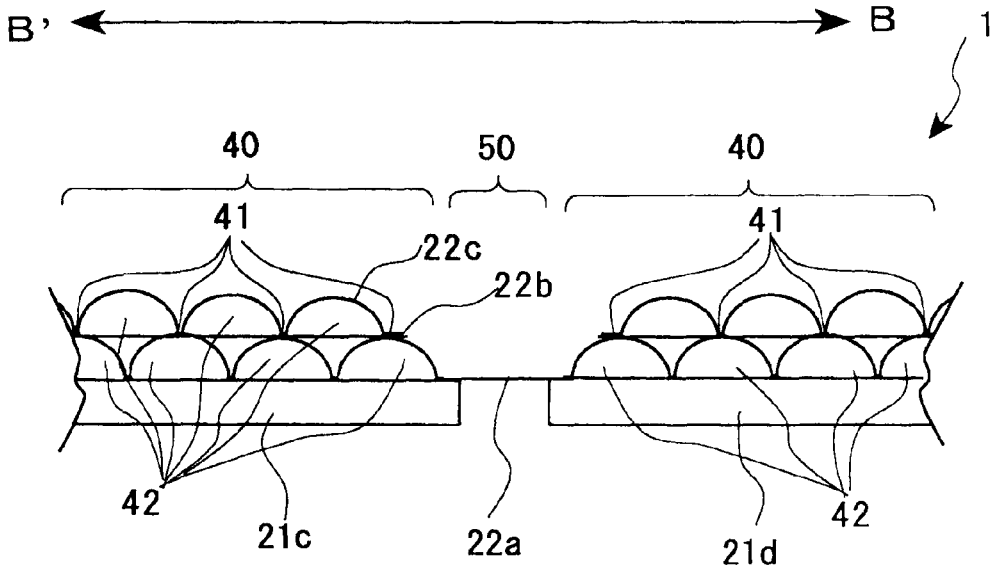
FIG. 4 is a schematic view showing a configuration of the packing material according to the embodiment of the present invention.

FIG. 4 is a schematic view showing a configuration of the packing material according to the embodiment of the present invention.

Here, as the plurality of the film members 22 overlap, the gas storing section 42 can be formed in a multi-stage.

As the plurality of film members 22 are thermally welded at predetermined intervals, the gas storing section 42 can be overlapped in a plurality of stages. As shown in FIG. 4, in order to form a second stage of the gas storing section 42, in addition to the film member 22*a* used to form a first stage, and further, using the film members 22*b* and 22*c*, similar to the planar section 40 being formed by the plate-shaped member 21 and the film member 22*a*, the welding section 41 and the gas storing section 42 are formed.

Here, since only the film members 22*b* and 22*c* are thermally welded and the film member 22*a* and the plate-shaped member 21 are not thermally welded, a separating material can be applied between the film member 22*a* and the plate-shaped member 21 to prevent welding thereof.

Accordingly, as the welding of the plate-shaped member 21, the film member 22*a* and the film member 22*b* and 22*c* is prevented, the gas storing section 42 can be formed in a plurality of stages.

Similar to the first stage, a gas is supplied into the gas storing section 42 after the second stage by the injection section 61, the circulation path 62 and the gas inlet port 64.

Figure 5A:
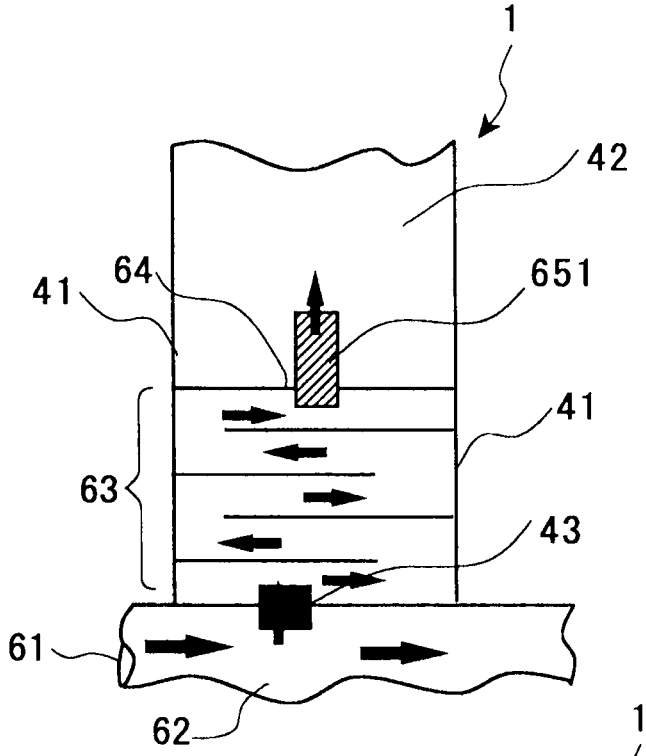
FIGS. 5A and 5B are views showing a path from an injection section to a gas storing section of the packing material according to the embodiment of the present invention, FIG. 5A showing a configuration from the injection section to the gas storing section, and FIG. 5B showing a cross-sectional view further showing a state in which a gas is filled.
Figure 5B:
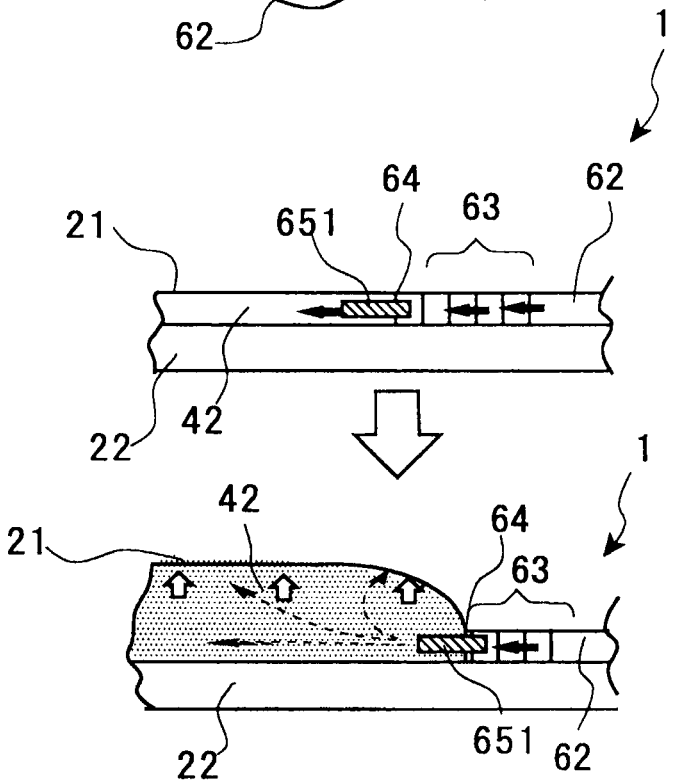

FIG. 5 is a view showing a path from the injection section to the gas storing section of the packing material according to the embodiment of the present invention, FIG. 5A showing a configuration from the injection section to the gas storing section, and FIG. 5B showing a cross-sectional view further showing a state in which a gas is filled.

As shown in FIG. 5A, in the planar section 40, the injection section 61 corresponding to an inlet into which a gas is injected and fed thereinto, the circulation path 62 through which the injected gas passes, the introduction path 63 into which the gas from the circulation path 62 is divided and flowed, and then the gas inlet port 64 configured to inject the gas from the introduction path 63 to the gas storing section 42 are connected to each other. As the gas injected from the gas inlet port 64 is stored, the gas storing section 42 is expanded. A non-fixed section 43 is formed at a portion from the circulation path 62 to the introduction path 63 and the gas inlet port 64 to inject the gas into the gas storing section 42.

In addition, as shown in FIG. 5A, the introduction path 63 has a path through which the gas passes, which is formed in a zigzag of a labyrinthine structure or a fine path structure. As a width and a length of the zigzag path are varied, a time in which the gas is stored in the gas storing section 42 can be adjusted. A time difference and a pressure difference of the supplied gas are generated by a distance from the injection section 61. Accordingly, a width of the path in a progress direction of the gas is increased in the zigzag path of the gas inlet port 64 in the gas storing section 42 far from the injection section 61. Further, a zigzag turn is reduced to reduce the length of the path itself. Accordingly, in the gas storing section 42 far from the injection section 61, the gas can be stored for a short time by the gas storing section 42 near the injection section 61.

In addition, a check valve 651 is installed at the gas inlet port 64 connected to the gas storing section 42. The check valve 651 may be inconvenient in the case of a three-dimensional shape having a cylindrical suction valve or a check valve, or having a certain height, or may cause damage to the plate-shaped member 21 and the film member 22. Accordingly, here, the thin check valve 651 formed of a film may be installed at the gas inlet port 64 of each of the gas storing sections 42. The thin check valve 651 formed of a film can prevent a flow of the gas or fluid from a current direction of the gas or fluid to a reverse direction.

As shown in FIG. 5B, in the packing material 1 in which the plate-shaped member 21 and the film member 22 are thermally welded to form the gas storing section 42 and the air is enclosed therein, the check valve 651 is used to enclose the air. Two sheets on which a release agent is printed or applied to prevent welding to the thermally weldable plate-shaped member 21 and the film member 22 are overlapped and sandwiched between the plate-shaped member 21 and the film member 22, both side edges are thermally welded, and the check valve 651 is used. Accordingly, in the packing material 1 of the present invention, a gas can be injected from the injection section 61 and stored in the gas storing section 42.

Figure 6A:
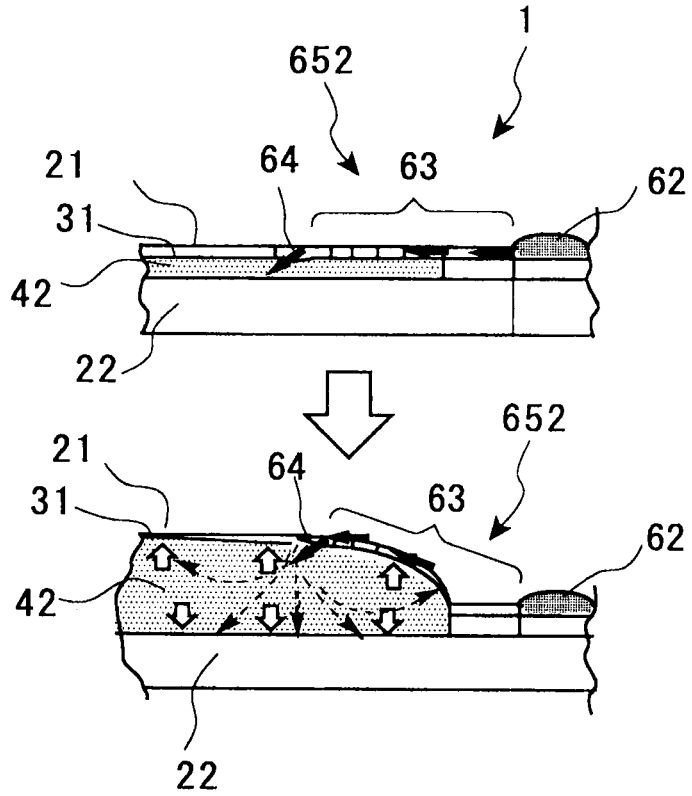
FIGS. 6A and 6B are views showing another path from the injection section to the gas storing section of the packing material according to the embodiment of the present invention, FIG. 6A showing a valve unit using one sheet member, and FIG. 6B showing the valve unit using two sheet members.
Figure 6B:
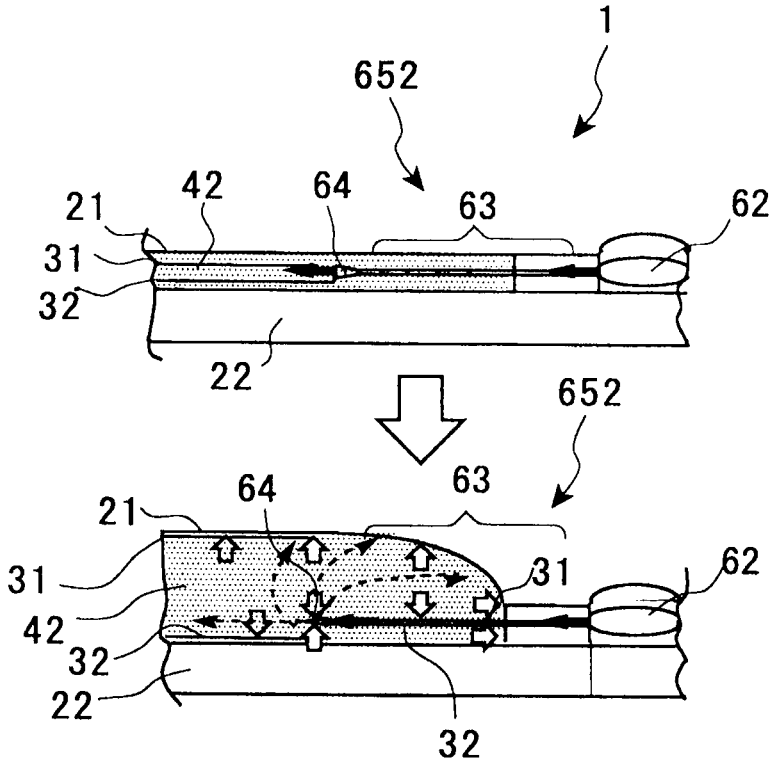

FIG. 6 is a view showing another path from the injection section to the gas storing section of the packing material according to the embodiment of the present invention, FIG. 6A showing a valve unit using one sheet member, and FIG. 6B showing the valve unit using two sheet members.

In addition, as shown in FIG. 6, here, the gas inlet port 64 is formed by cutting a sheet member 3 to form a slit. Accordingly, the gas is injected from the circulation path 62 to the gas storing section 42. The gas inlet port 64 may protrude in a substantially reversed C shape. Since an area into which the gas is injected can be increased according to the reversed C shape, an injection speed of the gas can be increased. In addition, after the gas storing section 42 is filled with the gas, as the sheet member 3 formed of a plastic film having flexibility is likely to be deformed, leakage of the gas can be reduced from a place that can be easily pressed against another film surface.

Further, the plate-shaped member 21 and the film member 22 constituting the packing material 1 are disposed, and the first sheet member 31 is disposed therebetween. As shown in FIG. 6A, the gas passes through the introduction path 63 from the circulation path 62, and is filled into the gas storing section 42 from the gas inlet port 64. A black arrow of the drawing represents a flow of the gas, and a white arrow represents a pressing force.

Here, as shown in FIG. 6A, the first sheet member 31 receives a pressure to be raised in an arrow direction. As the first sheet member 31 is raised to be adhered to the plate-shaped member 21 or the film member 22, the gas inlet port 64 and the introduction path 63 are narrowed. As a result, the injection of the gas is suppressed in a self-controlled manner so that a certain amount of gas is filled and stopped. After the gas is filled, the first sheet member 31 formed of a film having high flexibility presses the gas inlet port 64 and the introduction path 63 against the plate-shaped member 21 or the film member 22 to be covered from the inside, and there is no gas leaked from the gas storing section 42.

The packing material 1 of the present invention uses a plastic film having high flexibility at the gas inlet port 64 as a valve unit 652, without using the check valve 651, and the gas inlet port 64 can be pressed against the plate-shaped member 21 or the film member 22 forming the introduction path 63 to prevent the gas leakage by the pressure of the filled gas. In addition, when the check valve 651 is mounted on each of the gas storing sections 42, the plurality of check valves 651 are needed, and thus this is impractical in terms of cost as well as productivity. The packing material 1 of the present invention simply uses the sheet member 3 having flexibility as the valve unit 652, without using the check valve 651.

In addition, as shown in FIG. 6B, in the packing material 1 of the present invention, while the first sheet member 31 formed of one plastic film is disposed between the plate-shaped member 21 or the film member 22 and the packing material, at least two of the first and second sheet members 31/32 may be disposed as the valve unit 652.

In the embodiment, in the packing material 1 of the present invention, the introduction path 63 and the gas inlet port 64 are constituted by the first and second sheet members 31/32. When the gas storing section 42 is filled with the gas, the pressure of the gas storing section 42 is increased, the gas storing section 42 is expanded, and the introduction path 63 and the gas inlet port 64 are closed by the internal pressure thereof to be operated as the valve unit 652. Here, as shown in FIG. 7B, the first and second sheet members of the valve unit 652 do not stay in the gas storing section 42 such as the introduction path 63. Otherwise, the first and second sheet members 31/32 of the valve unit 652 are pressed against the plate-shaped member 21 or the film member 22 to be adhered thereto. In any case, after the gas is filled by the internal pressure, the gas inlet port 64 is filled from the inside to be operated as the valve unit 652 to prevent leakage of the gas of the gas storing section 42.

In addition, the injection section 61 and the circulation path 62 may be installed between the two sheet members 31/32. Further, the introduction path 63, the gas inlet port 64 and the gas storing section 42 may be installed at the injection section 61 and the circulation path 62 without installing the two sheet members. In any case, it is sufficient if the two sheet members 31/32 serve as the valve unit 652 by the internal pressure of the gas in the gas storing section 42.

Figure 7A:
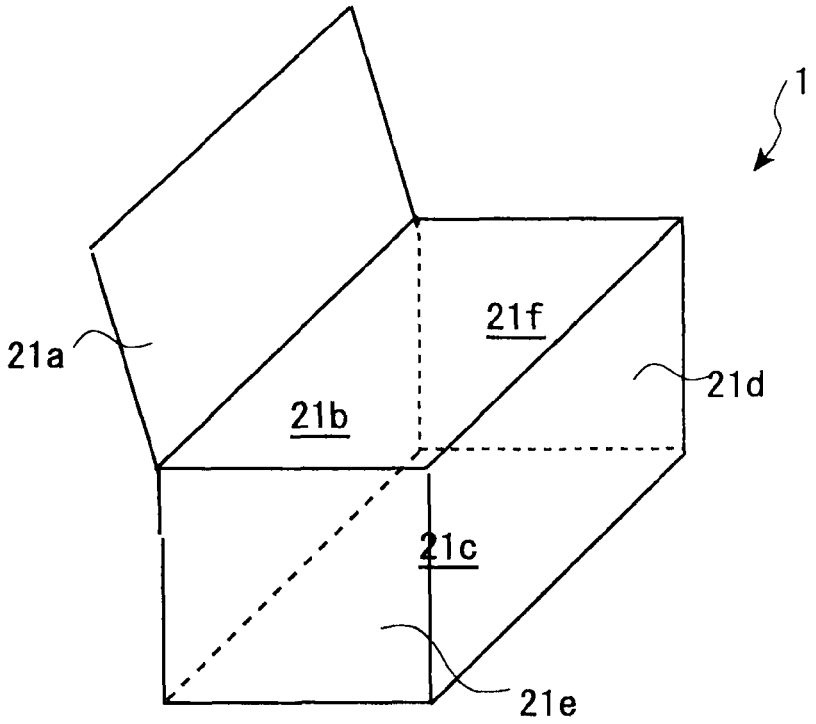
FIGS. 7A and 7B are schematic views showing a state in which the packing material according to the embodiment of the present invention is assembled, FIG. 7A showing a state in which only the plate-shaped member is assembled, and FIG. 7B showing a state in which the plate-shaped member is assembled with a film member.
Figure 7B:
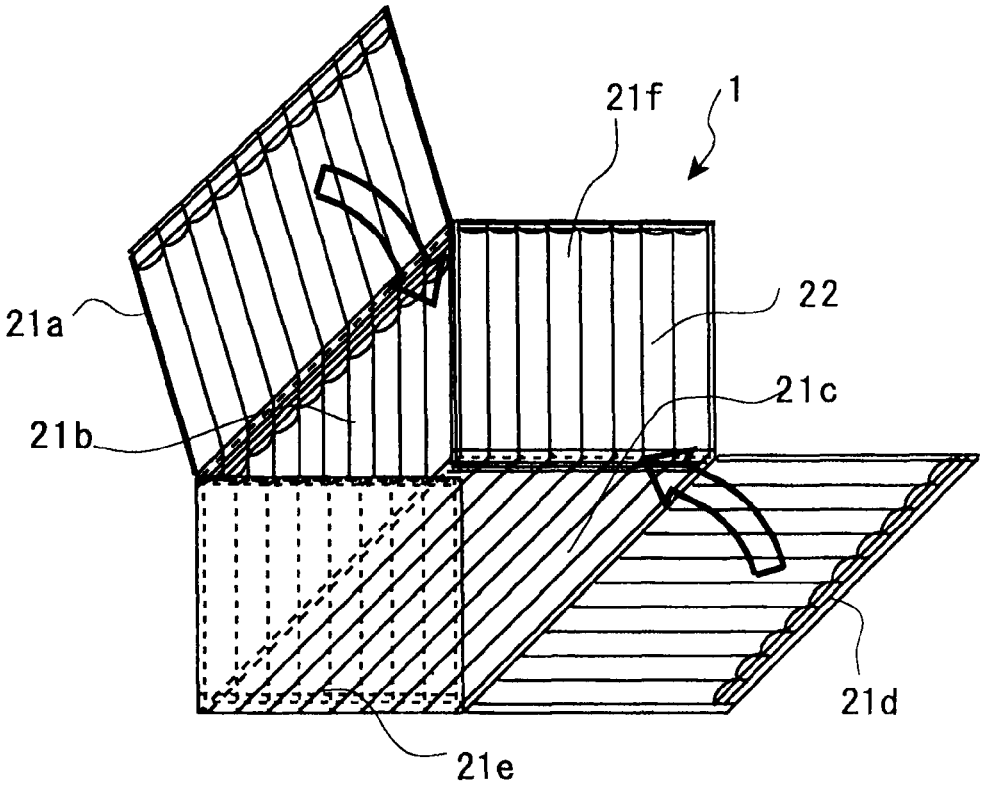

FIG. 7 is a schematic view showing a state in which the packing material according to the embodiment of the present invention is assembled, FIG. 7A showing a state in which only the plate-shaped member is assembled, and FIG. 7B showing a state in which the plate-shaped member is assembled with a film member.

Figure 8:
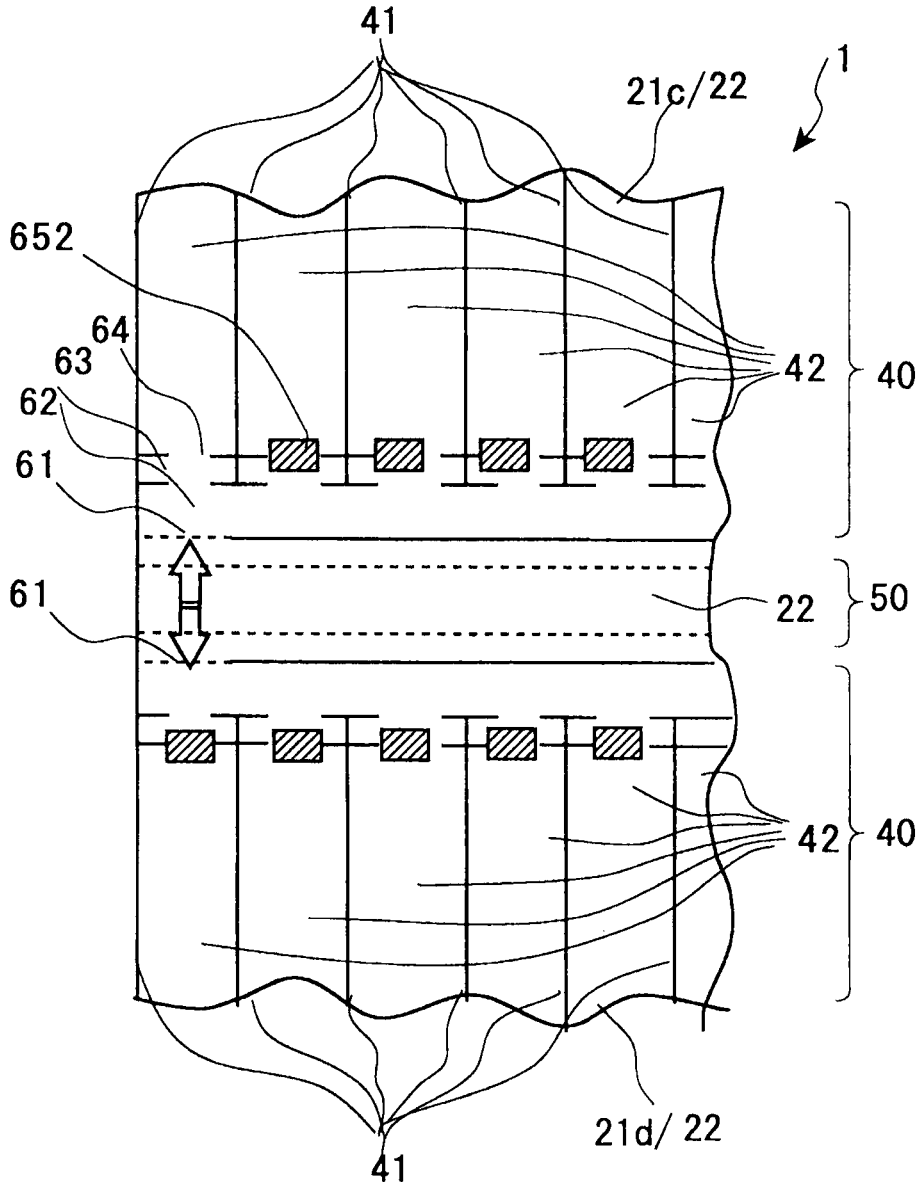
FIG. 8 is a schematic view showing a configuration of the packing material according to the embodiment of the present invention.

FIG. 8 is a schematic view showing a configuration of the packing material according to the embodiment of the present invention.

As shown in FIG. 7A, as the six plate-shaped members 21 are used, the material to be packed 90 is perfectly closed and protected.

In addition, as shown in FIG. 7B, in the packing material 1 of the present invention, the entire inside of the packing material 1 covers the film member 22 to form the gas storing section 42 or the like to supply and store the air, and thus the material to be packed 90 is protected from an impact to prevent destruction and damage. In this case, each of the plate-shaped members 21*a* to 21*f* is not common with the injection section 61, the circulation path 62, the introduction path 63, the gas inlet port 64, and the gas storing section 42, and the planar section 40 formed by each of the plate-shaped members 21*a* to 21*f* independently has the injection section 61, the circulation path 62, the introduction path 63, the gas inlet port 64, and the gas storing section 42. Accordingly, the injection sections 61 corresponding to the number of plate-shaped members 21 are formed.

A position of the injection section 61 is not particularly limited. As shown in FIG. 2, the position may be the circumferential edge sections of the plate-shaped member 21 and the film member 22. In addition, as shown in FIG. 8, the injection section 61 may be formed at the inside of the planar section 40 near the connecting section 50, rather than a portion near an end surface of the plate-shaped member 21. In this case, a portion that becomes the injection section 61 is a non-welding section, which is not thermally welded, and the gas is injected therefrom. After injection of the gas, the injection section 61 is closed by a bonding agent, an adhesive tape, or by applying heat to weld or thermally weld the injection section 61 of the film member 22 and the plate-shaped member 21. Here, as described above, the injected gas is stored in the gas storing section 42 via the circulation path 62, the introduction path 63, and the gas inlet port 64. Here, when the valve unit 652 is installed at the gas inlet port 64, even when the injection section 61 is not closed, the gas of the gas storing section 42 is not leaked to the outside.

In addition, a fluid, for example, a gas such as air or an inert gas, a liquid such as water or alcohol, and so on, can be stored in the gas storing section 42. Among them, air has a low thermal conductivity, and ice can be inserted into the packing material 1 to be used as the packing material 1 for cooling.

Further, in FIG. 7B, while only one stage of the gas storing section 42 is shown, the number of stages can be appropriately applied to each of the plate-shaped members 21*a* to 21*f* to correspond to the material to be packed 90. In addition, in addition to the number of stages, appropriate addition and omission of each of the stages can further correspond to the shape of the material to be packed 90.

Figure 9:
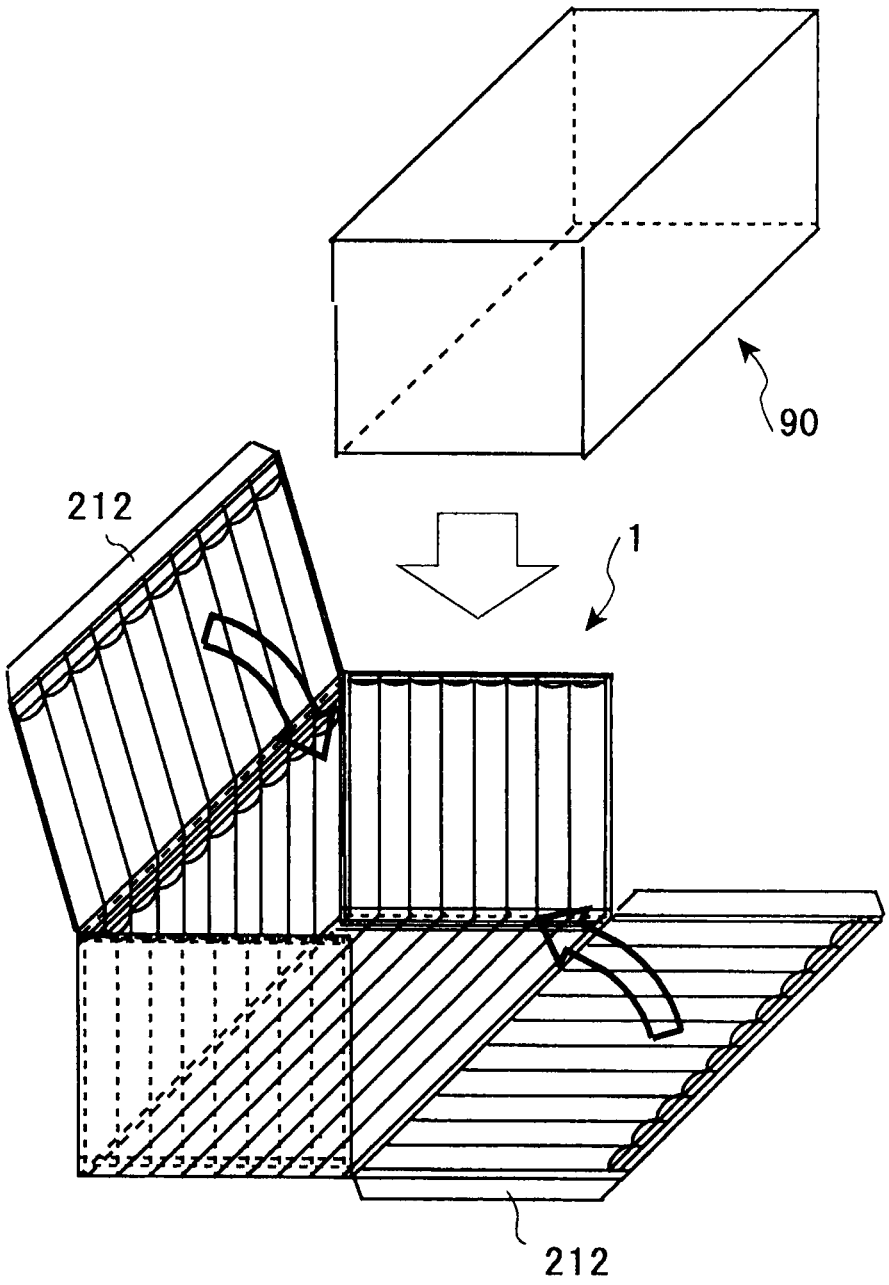
FIG. 9 is a schematic view showing a configuration of the packing material and a packing method according to the embodiment of the present invention.

FIG. 9 is a schematic view showing a configuration of the packing material and a packing method according to the embodiment of the present invention.

As shown in FIG. 9, in the packing material 1 of the present invention, after the material to be packed 90 is stored therein, the packing material 1 is assembled to perfectly store the material to be packed 90, and the material to be packed 90 is protected from an impact, preventing destruction and damage.

Here, the plate-shaped member 21 is adhered and fixed by an adhesive tape. In addition, a tab 212 is formed at the plate-shaped member 21 to fix the plate-shaped members 21 with a bonding agent. Further, when the plate-shaped member 21 is paper such as corrugated cardboard or the like, the plate-shaped member 21 and the tab 212 may be fixed by a pin by a stapler, a tucker, or the like. In this case, while a hole may be closed at the gas storing section 42 to disable storage of the gas, the material to be packed 90 can be protected by another gas storing section 42 if the hole is partial.

Figure 10A:
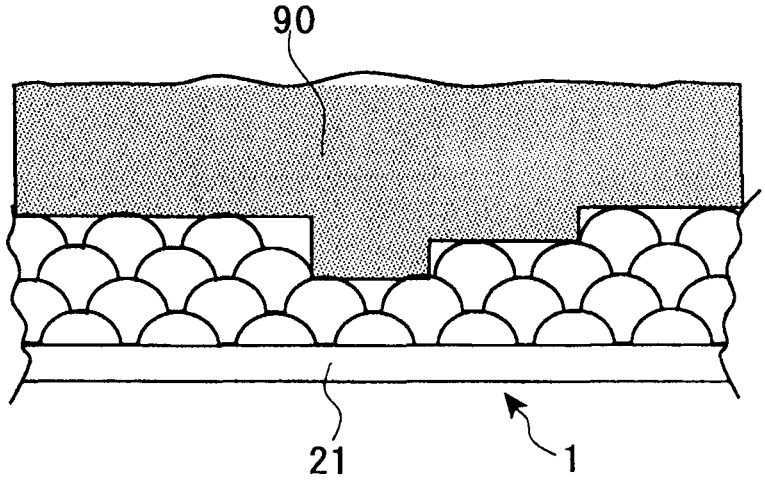
FIGS. 10A, 10B and 10C are schematic views showing a configuration of the packing material according to the embodiment of the present invention, FIG. 10A showing a state in which a material to be packed having a stepped surface shape is protected, FIG. 10B showing a state in which a material to be packed having a stepped surface shape, a portion of which has no gas storing section, is protected, and FIG. 10C showing a state in which a material to be packed having a curved surface shape is protected.
Figure 10B:
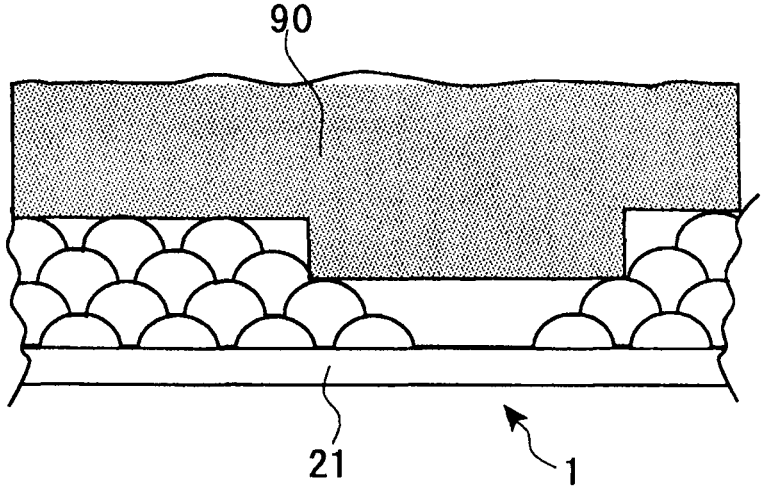
Figure 10C:
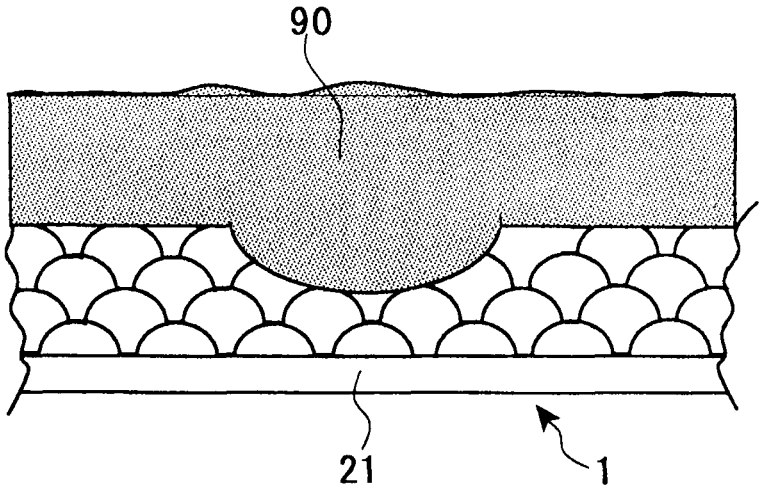

FIG. 10 is a schematic view showing a configuration of the packing material according to the embodiment of the present invention, FIG. 10A showing a state in which a material to be packed having a stepped surface shape is protected, FIG. 10B showing a state in which a material to be packed having a stepped surface shape, a portion of which has no gas storing section, is protected, and FIG. 10C showing a state in which a material to be packed having a curved surface shape is protected.

As shown in FIG. 10A, a size of the gas storing section 42 is appropriately adjusted to correspond to a size and a height of a stepped surface formed in the material to be packed 90, and the plurality of gas storing sections 42 are always in contact with the surfaces of the material to be packed 90.

In addition, as shown in FIG. 10B, the material to be packed 90 can be protected by the packing material 1 of the present invention, even when the gas storing section 42 is partially unprepared. Even when the gas storing section 42 is not in contact with the material to be packed 90, as the gas storing section 42 of the packing material 1 comes in contact with and abuts the material to be packed 90 at the other portion, protection from an impact and prevention of destruction and damage become possible.

Further, in a portion in which the gas storing section 42 is not present, there are the case in which the film member 22 is not present, and the case in which while the film member 22 is present but the gas storing section 42 is not formed. When the film member 22 is not present, cost can be reduced by omitting the film member 22. When the gas storing section 42 is not formed, productivity can be increased by omitting a manufacturing process.

In addition, as shown in FIG. 100, the size of the gas storing section 42 can be appropriately adjusted and can conform to the size and height of a curved surface formed in the material to be packed 90.

Accordingly, the material to be packed 90 can always be protected. In addition, even when a large impact is applied to the material to be packed 90, destruction and damage of the material to be packed 90 can be prevented by distributing and reducing the impact.

Figure 11A:
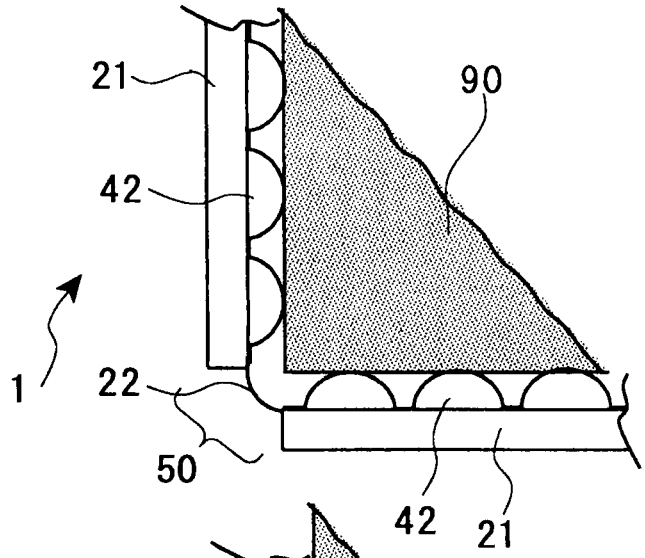
FIGS. 11A, 11B and 11C are schematic views showing a configuration of the packing material according to the embodiment of the present invention, FIG. 11A showing a state in which a connecting section is connected to a film member, FIG. 11B showing a state in which a portion of the plate-shaped member is connected to the film member, and FIG. 11C showing a state connected to the plate-shaped member.
Figure 11B:
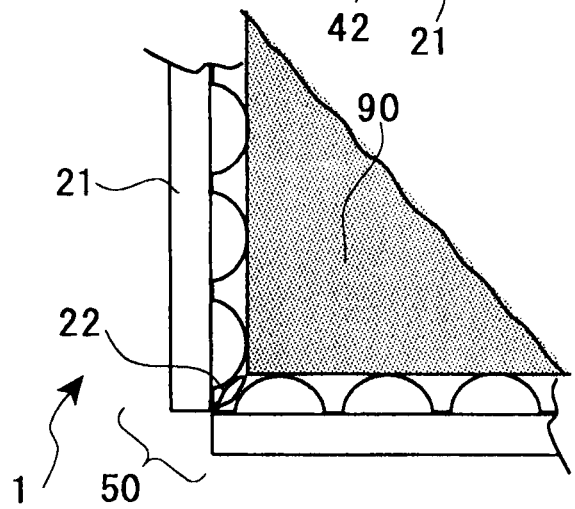
Figure 11C:
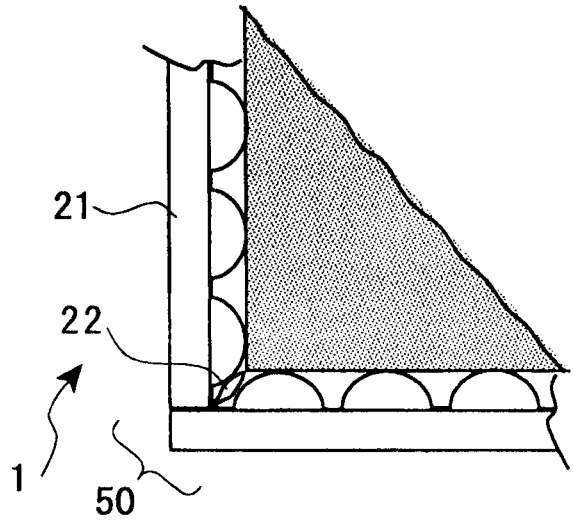

FIG. 11 is a schematic view showing a configuration of the packing material according to the embodiment of the present invention, FIG. 11A showing a state in which a connecting section is connected to a film member, FIG. 11B showing a state in which a portion of the plate-shaped member is connected to the film member, and FIG. 11C showing a state connected to the plate-shaped member.

The packing material 1 of the present invention is not particularly limited to a state of the connecting section 50.

As shown in FIG. 11A, the packing material 1 of the present invention is shown in a state in which the connecting sections 50 are connected by the film member 22. The connecting section 50 of the packing material 1 of the present invention corresponding to a portion in contact with a corner of the material to be packed 90 is in a free state with no restriction. Even in this state, the gas storing section of the planar section is in contact with the surface of the material to be packed 90 to protect the material to be packed 90. In this state, the packing material 1 of the present invention is connected to the packing material 1 or the material to be packed 90 by an adhesive tape or a double-sided adhesive tape. Otherwise, the packing material may be fixed by a band or a string.

In addition, as shown in 11B, the packing material 1 of the present invention is shown in a state in which a portion of the plate-shaped member 21 and the film member 22 are connected. Corners of the plate-shaped members 21 are joined. When the plate-shaped member 21 is corrugated cardboard, this state may be obtained from a state in which a portion is cut but the whole member is not separated therefrom. In this case, unlike FIG. 11A, the connecting section 50 is stored therein. In addition, as the connecting section 50 stored therein is thermally welded, strength of the connecting section 50 is increased, and strength of the packing material 1 itself is increased. Accordingly, even when a large impact is applied to the material to be packed 90, the impact can be distributed and received to prevent destruction and damage of the material to be packed 90. In addition, the material to be packed 90 having a heavy weight can also be packed and protected. Here, further, the packing material 1 of the present invention is connected to the packing material 1 or the material to be packed 90 by an adhesive tape or a double-sided adhesive tape. Otherwise, the packing material may be fixed by a band or a string.

In addition, as shown in FIG. 11C, the packing material 1 of the present invention is shown in a state in which the plate-shaped member 21 is also connected. As the surface of the plate-shaped member 21 and the end surfaces of the plate-shaped members 21 are joined, the material to be packed 90 can be securely protected. In this case, after the end surfaces of the plate-shaped members 21 are joined, the film member 22 having thermal weldability is thermally welded, and then the gas is supplied to fill the gas storing section 42. Further, the material to be packed 90 is stored and then fixed to the packing material 1 or the material to be packed 90 by an adhesive tape or a double-sided adhesive tape. Otherwise, the packing material may be fixed by a band or a string.

Figure 12:
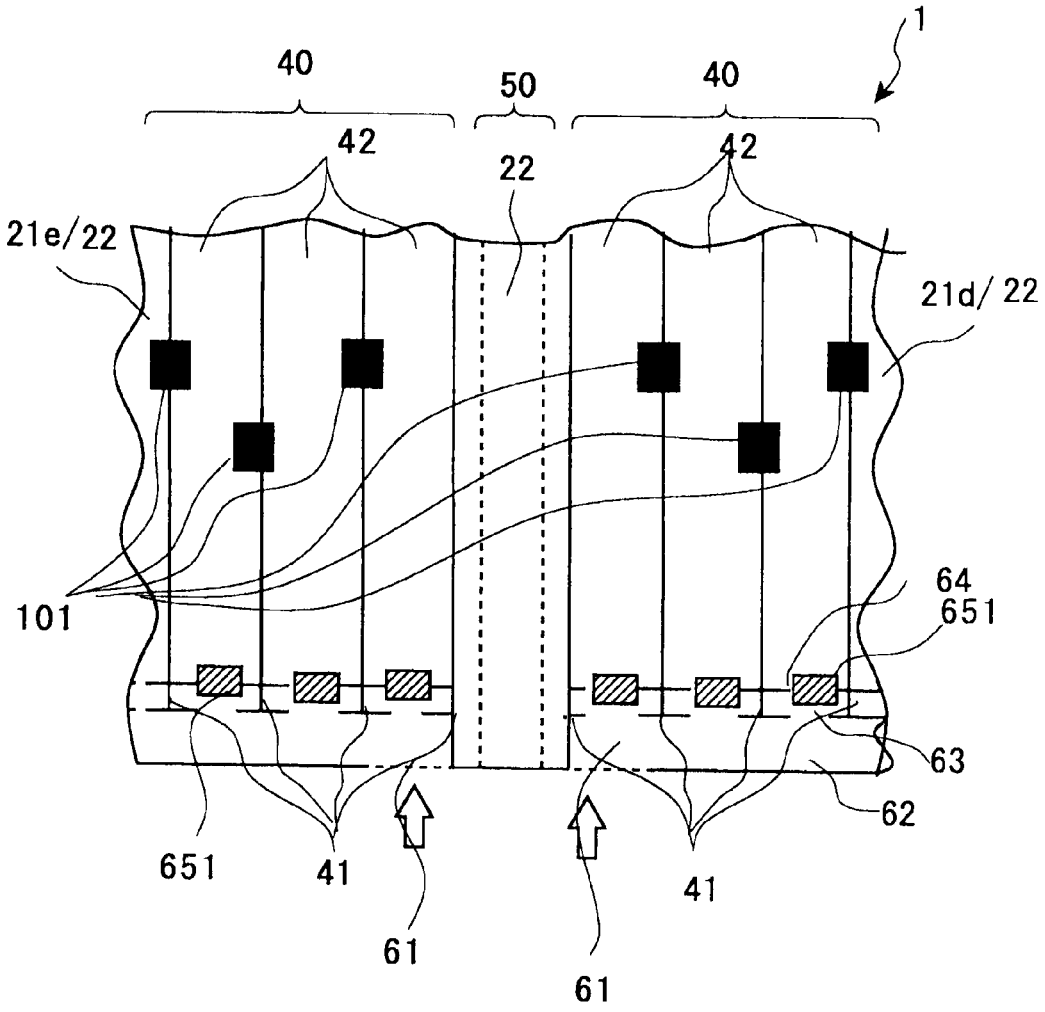
FIG. 12 is a view showing a configuration of a packing material according to another embodiment of the present invention.

FIG. 12 is a view showing a configuration of a packing material according to another embodiment of the present invention.

In the packing material 1 of the present invention, all of the gas storing sections 42 are connected while portions of the planar section 40 and the connecting section 50 are not thermally welded, and the gas is injected by one of the injection sections 61.

As shown in FIG. 12, the gas is supplied from one of the injection sections 61, and the gas is supplied into the gas storing section 42 from the short circulation path 62 via the introduction path 63 and the gas inlet port 64. However, as a release agent or the like is printed or applied on portions of the thermal welding sections 41 of the planar section 40 and the connecting section 50, thermal welding of the plate-shaped member 21 and the film member 22 is prevented, and a communication section 101 through which the gas can pass is formed. In addition, the communication section 101 comes in communication with a portion of the gas storing section 42.

Accordingly, when disposed at the material to be packed 90 and the material to be packed 90 receives a large pressure, some of the gas of the gas storing section 42 of the connecting section 50 moves to the gas storing section 42 of the planar section 40. Accordingly, the gas storing section 42 of the connecting section 50 can prevent damage due to the pressure.

Figure 13:
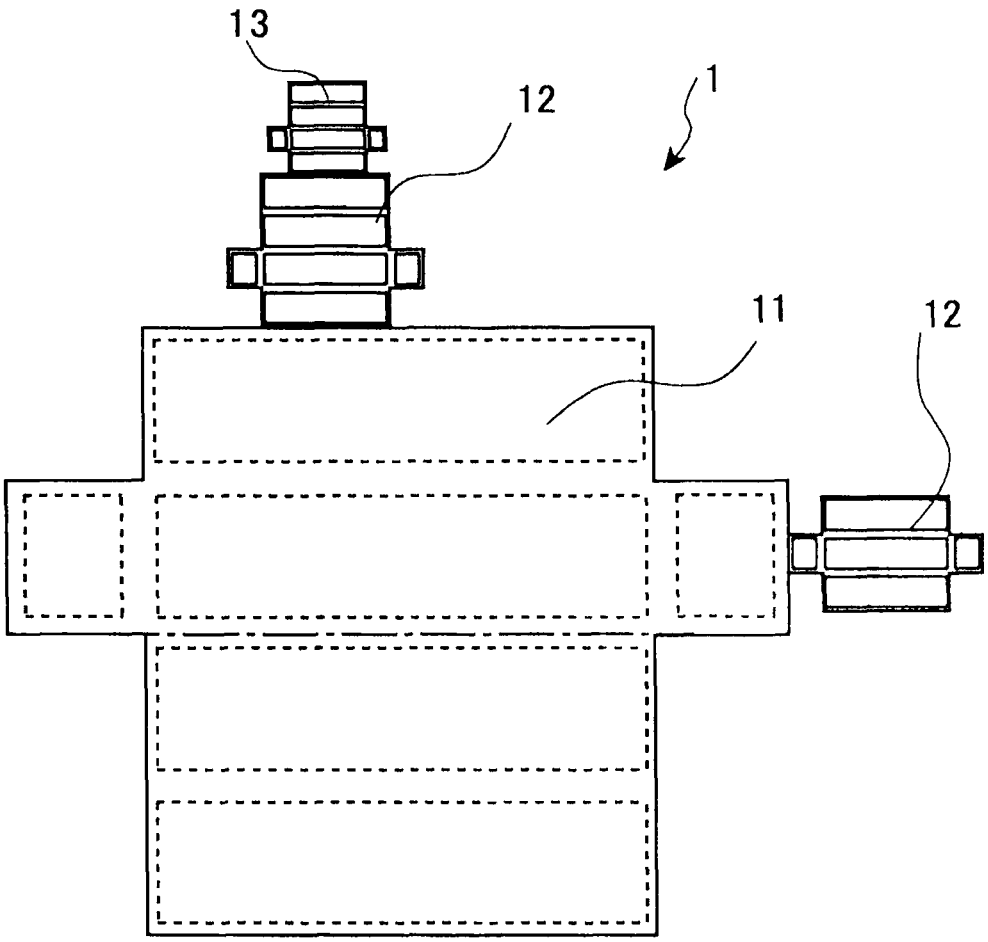
FIG. 13 is a view showing a configuration of a packing material according to another embodiment of the present invention.

FIG. 13 is a view showing a configuration of a packing material according to another embodiment of the present invention.

In the packing material 1 of the present invention, a plurality of packing materials 11 and 12 are connected. Accordingly, the small packing material 12 can be connected to the large packing material 11. The small packing material 12 is also connected to the packing material 12 by the film member 22 to form the packing material 1 in which a material can be further stored. In addition, a smaller packing material 13 may be connected to the small connected packing material 12. Further, the number of connected packing materials 1 is not limited.

In addition, the small packing material 12 formed therein is covered by the large packing material 11, even though the small packing material 12 has no upper surface serving as a cover.

The invention claimed is:

1. A packing material comprising:

a plate-shaped member having a surface of thermal weldability; and a plurality of gas storing sections formed by thermally welding a plastic film member having thermal weldability and flexibility and configured to store a gas;

a plurality of planar sections comprising the gas storing sections and formed by linearly thermally welding the plate-shaped member and the plastic film member; and a connecting section connecting the planar sections, and wherein the packing material is bent at the connecting section to form a three-dimensional shape to store a material to be packed, each planar section comprises;

an injection section configured to inject a gas from outside, a circulation path to the gas storing section configured to store the gas from the injection section, and a gas inlet port configured to fill the gas from the circulation path to the gas storing section, and the gas inlet port has a check valve configured to prevent leakage of the filled gas.

2. The packing material according to claim 1, wherein the plastic film members covers the plate-shaped member.

3. The packing material according to claim 1, wherein the plate-shaped member comprises six members and is used to assemble a rectangular parallelepiped body.

4. The packing material according to claim 1, wherein the packing material comprises a plurality of plastic film members overlapping to form gas storing sections so that the planar sections include multiple layers of the gas storing sections.

5. The packing material according to claim 4, wherein the multiple layers of the gas storing sections are disposed at each planar section.

6. The packing material according to claim 1, wherein the gas inlet port forms a valve unit with one or two sheet members inserted between two sheets of the plate-shaped member and the plastic film members.

7. The packing material according to claim 1, wherein all of the gas storing sections are connected without thermally welding portions of each planar section and the connecting section, and a gas is injected into the gas inlet port.

* * * * *